United States Patent [19]

Ragan et al.

[11] 4,323,141

[45] Apr. 6, 1982

[54] RAIL-MOUNTED VEHICLE JACK

[75] Inventors: Marshall P. Ragan, Mayflower; Peter H. Sytsma, Greenbrier, both of Ark.

[73] Assignee: FMC Corporation, Chicago, Ill.

[21] Appl. No.: 129,306

[22] Filed: Mar. 11, 1980

[51] Int. Cl.[3] ..... B66F 7/18

[52] U.S. Cl. ..... 187/8.47; 254/93 HP

[58] Field of Search ..... 254/89 H, 93, 93 HP, 254/122; 187/8.41, 8.71, 8.49, 8.5, 8.47

[56] References Cited

U.S. PATENT DOCUMENTS

| | | | |
|---|---|---|---|
| 1,878,665 | 9/1932 | Bennett . | |
| 2,229,113 | 1/1941 | Mizer | 254/89 |
| 2,610,824 | 9/1952 | Grier | 254/93 |
| 2,736,104 | 2/1956 | Sherman . | |
| 3,174,722 | 3/1965 | Alm | 254/93 |
| 3,556,481 | 1/1971 | Mueller et al. | 254/122 |
| 3,730,366 | 5/1973 | Berends | 254/93 HP |
| 3,783,976 | 1/1974 | Kerr | 187/8.47 |
| 3,994,474 | 11/1976 | Finkbeiner | 254/88 |
| 4,050,545 | 9/1977 | Hunter | 187/8.43 |

*Primary Examiner*—Stanley H. Tollberg
*Attorney, Agent, or Firm*—Henry M. Stanley; Richard B. Megley

[57] ABSTRACT

A vehicle jack adapted to mount on a drive-on vehicle hoist comprises a lower platform suspended between the two rails of the hoist, an upper platform having a plurality of shoes adapted to contact the vehicle frame, an air bag between the upper and lower platforms to provide the force necessary to raise the vehicle from the rails, and a pair of scissor-type assemblies each having opposite corners attached to the upper and lower platforms respectively and adapted to maintain the upper and lower platforms in a parallel orientation. A plurality of latch plates connected to the upper platform are canted against latch posts mounted on the lower platform in such a way that downward movement of the upper platform is prevented unless the latch plates are moved out of contact with the posts. A pneumatic interlock system allows the latch plates to be moved only when there is sufficient air pressure in the air bag to support the vehicle. In this way, sudden collapse of the jack is avoided.

11 Claims, 6 Drawing Figures

RAIL-MOUNTED VEHICLE JACK

BACKGROUND OF THE INVENTION

1. Field of the Invention

This invention generally relates to automobile jacks. More particularly, the present invention concerns fluid-actuated automobile jacks of the type which may be mounted between the rails of an automobile hoist.

2. Description of the Prior Art

As used herein, the term vehicle hoist will refer to an apparatus to raise the whole of a vehicle from the ground. One type of vehicle hoist comprises a pair of parallel rails onto which the vehicle drives. The rails are then raised from the ground, thus elevating the vehicle. This type of vehicle hoist is commonly referred to as a "drive-on hoist" and typically is used in aligning vehicle wheels.

During alignment operations, it is often necessary to raise one end of the vehicle from the hoist so that the tires are lifted from the rails. Various means have been used to accomplish this. Most simply, a single-acting piston jack may be placed on one of the hoist rails and used to raise one wheel of the vehicle in much the same manner as when a motorist changes a tire. Vehicle jacks have also been adapted to mount between the rails of the vehicle hoist and, when properly positioned, to raise the entire front end or the entire rear end of the vehicle. Jacks of this generic type are disclosed in the patents to Mueller et al. U.S. Pat. No. 3,556,481 and to Hunter U.S. Pat. No. 4,050,545. Generally, these jacks display a frame which is suspended between the rails of the vehicle hoist, an upper platform with contact shoes for engaging the vehicle frame, hydraulic means for raising the upper platform relative to the frame, and locking means for preventing collapse of the jack in the event of failure of the hydraulic lifting system.

A shortcoming has been noted in the prior art. While the locking systems disclosed will prevent collapse of the jack in the event of hydraulic system failure, the locking systems may be released at any time. Should the locking system be accidentally released while pressure is maintained in the hydraulic system, there is no problem since the load will still be supported. However, should the locking system be accidentally released when there is insufficient pressure in the hydraulic system, the jack will collapse with possible injury to people and property.

SUMMARY OF THE INVENTION

By the present invention a mobile vehicle jack is provided particularly for use with drive-on vehicle hoists which jack includes a mechanism for automatically latching the elevating platform of the jack when it is raised from the support frame structure and which further includes means for preventing the release of the latching mechanism should the fluid-actuated platform lifting means lose pressure while a vehicle is elevated on the platform. Thus, the actuation of the latch releasing means by the hoist operator will not create a situation wherein the jack platform will suddenly collapse to cause possible injury to the hoist operator or damage to the hoist apparatus and/or the vehicle supported thereby.

In order to obtain the aforedescribed feature of the present invention, fluid communication is provided between the lifting means and a control means which acts to block the flow of fluid pressure to the fluid-actuated latch releasing means. Thus, when pressure is lost in the lifting means the control means is actuated so as to block fluid pressure to the latch releasing means whereby such latch releasing means cannot thereafter be actuated without the repressurization of the lifting means. In the preferred embodiment of the invention, the fluid-actuated components are all pneumatic and the lifting means comprises an air bag.

Another feature of the present invention is the particular structure of the latching mechanism which operates automatically at any elevated position to latch the elevated platform and prevent its descent to the jack frame structure. This latching mechanism basically comprises a upright post mounted on the supporting frame structure of the jack and a pivotable latch plate secured to the platform. The latch plate has an aperture therethrough for receiving the post with the size of the aperture being such in relationship to the exterior dimensions of the post that diametrically opposite upper and lower side edges of the aperture are caused to bite into the post when the platform is urged to move downwardly on said post. To release the latching mechanism, means are provided for pivoting the latch plate to cause the aperture therein to become aligned with the post thus allowing the platform to descend on the post.

DESCRIPTION OF THE PREFERRED EMBODIMENT

Figure 1:
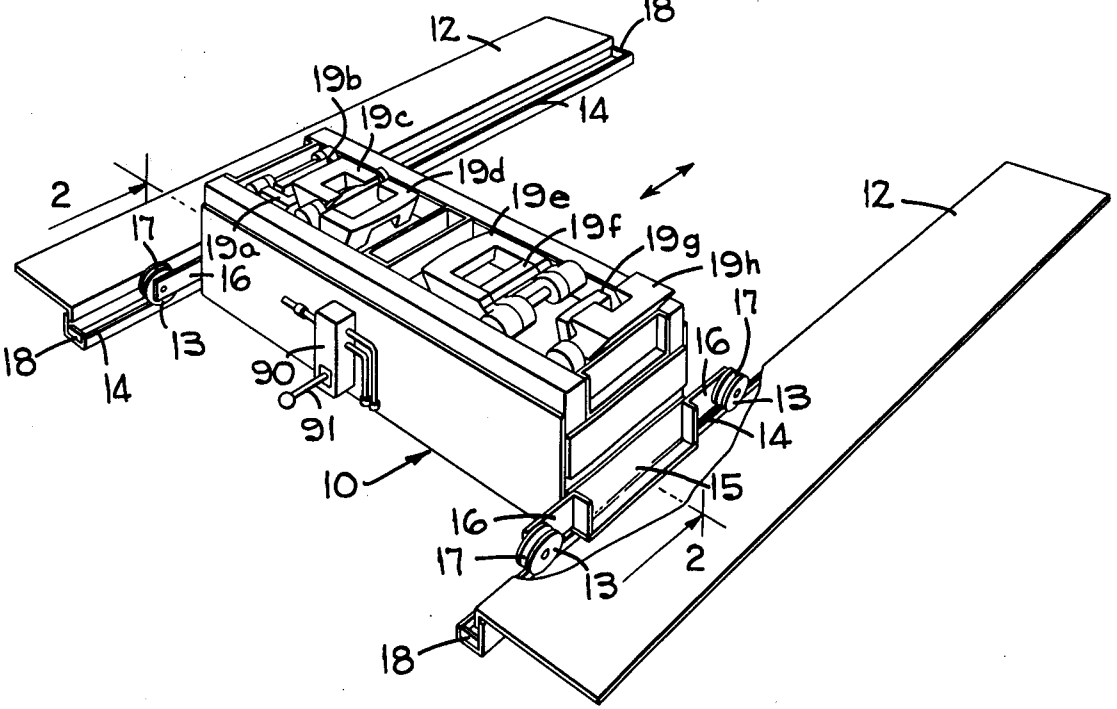
FIG. 1 is a perspective of a vehicle jack of the type employing the present invention mounted on a vehicle hoist.

Referring to FIG. 1, a vehicle jack 10 embodying the present invention is shown suspended between two rails 12 of a vehicle hoist. A vehicle (not shown) is driven on to the rails 12 when the hoist is in a lowered position. The hoist is then raised from the ground by means not shown and the vehicle is raised along with it.

The vehicle jack 10 is mounted on wheels 13 which engage a U-shaped flange 14 along the inner edge of each rail 12. The wheels 13 are individually attached at each corner of the jack 10, as shown in FIG. 1. An L-shaped support member 15 is attached at each end of the jack 10 (only one of the two such support members being visible in FIG. 1) and two wheel support brackets 16 are mounted on each support member. The wheels 13 are rotatably attached to the wheel brackets 16. Each wheel has an annular depression 17 about its periphery which is capable of receiving the flange 14 associated with one of the rails 12. The flanges 14 together form a pair of tracks and the vehicle jack 10 is free to roll along these tracks. In this way, the jack 10 may be moved beneath either the front or the rear of the vehicle, as desired. Stop members 18 at each end of both flanges 14 prevent the vehicle jack 10 from rolling off the rails 12. In operation, the vehicle jack 10 is held in place by the weight of the vehicle being lifted.

Figure 2:
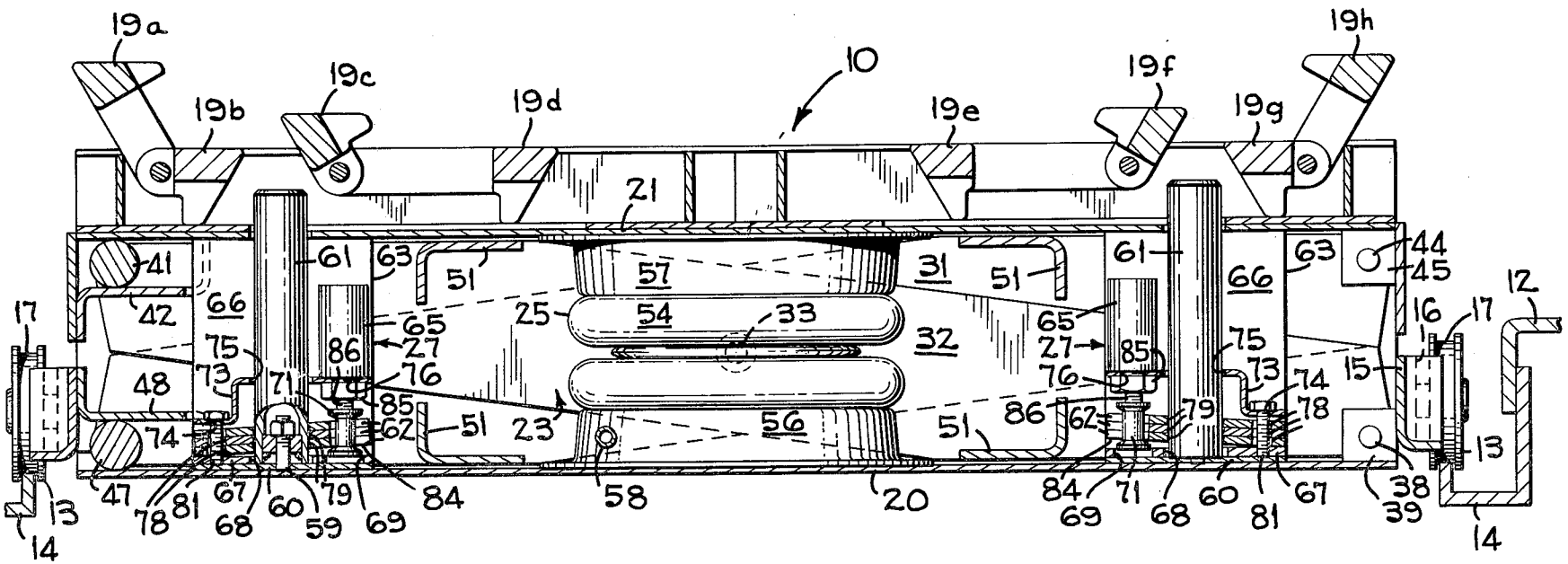
FIG. 2 is a section taken along line 2—2 of FIG. 1 illustrating the vehicle jack in its lowered configuration.
Figure 3:
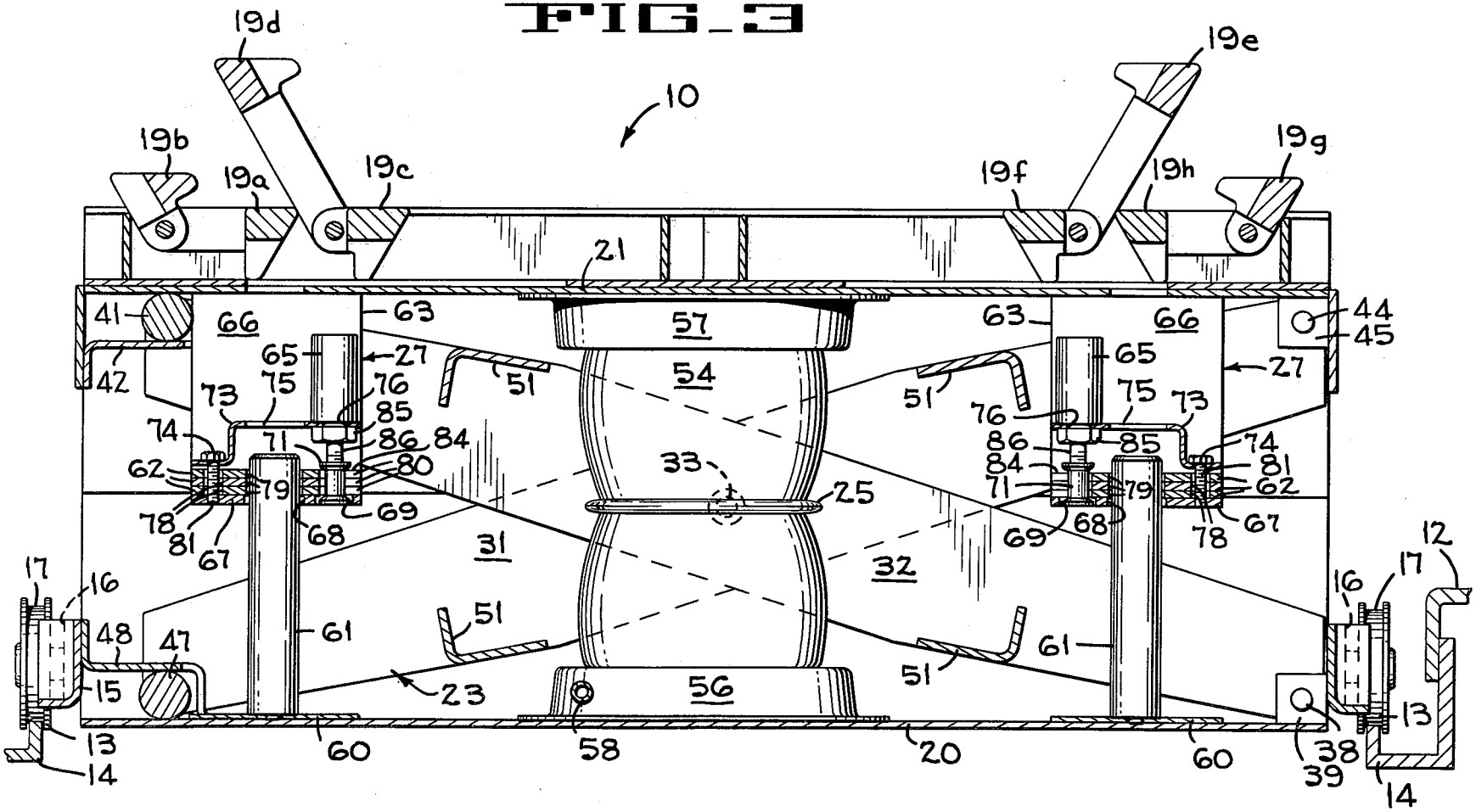
FIG. 3 is a section of the vehicle jack similar to that of FIG. 2, except that the jack is in a raised position.

Referring to FIGS. 2 and 3, the primary structural elements of the vehicle jack 10 are a lower platform 20, an upper platform 21, and a pair of scissor assemblies 23 connecting the upper and lower platforms 21, 20 and adapted to maintain said platforms parallel to one another as the upper platform is elevated relative to the lower platform. The support members 15 are mounted on the lower platform 20 and thus the wheels 13 are fixed relative to the lower platform 20 and the lower platform is fixed vertically relative to the rails 12 of the hoist.

The major assemblies within the vehicle jack 10 include an air bag assembly 25 to power the jack, a pair of latching assemblies 27 to prevent accidental collapse of the jack, and a pneumatic system interconnecting the air bag assembly with the latching assemblies.

A plurality of contact shoes 19*a*–19*h* are pivotally mounted on the upper side of the upper platform 21 of the vehicle jack 10. Each of these shoes may be in a raised or a lowered position, as seen in FIGS. 1, 2 and 3. For example, shoes 19*a* and 19*h* are shown in a raised position in FIG. 2, while the remainder of the contact shoes are in a lowered position. It will be noted that the eight contact shoes are arranged in pairs where each member of the pair is located symmetrically about the central transverse plane of the jack 10. The pair of contact shoes to be raised will be chosen depending on the frame of the car being elevated. The shoes selected will be raised prior to elevating the jack 10 and will contact the frame at the proper points for lifting the vehicle. The remainder of the shoes will be in their lower position.

The two scissor assemblies 23 each including two links 31, 32 extend axially across the jack 10. The two links 31, 32 of each scissor assembly 23 are connected by a pivot pin 33 connecting the links in a conventional manner. In viewing FIGS. 2 and 3, note that only the rearmost scissor assembly is visible; however, the construction of the second scissor assembly is a mirror image of the first and a description of the visible assembly will serve for the other assembly as well.

Referring to the scissor assembly 23, as illustrated in FIGS. 2 and 3, the lower end of the link 32 is pivotally attached to the right side of the lower platform 20 by a pivot pin 38 extending horizontally through a vertical plate 39, said plate being fixed to the lower platform. Extending transversely between the left upper end of link 32 and the upper end of the corresponding link in the second scissor assembly, is a roller bar 41. The roller bar 41 is enclosed within a sheet metal housing 42 extending transversely across the underside of upper platform 21 and attached thereto. The roller bar 41 is rotatably attached at its ends to each of the links 32 and is thus capable of rolling back and forth within the housing 42.

Link 31 of the scissor assembly 23 is pivotally attached to the underside of the upper platform 21 on the right side thereof as viewed in FIGS. 2 and 3. A pivot pin 44 extends through a vertical plate 45 which in turn is attached to the upper platform 21. A roller bar 47 is rotatably attached to the lower (left) end of link 31 and extends transversely across the jack 10 to a corresponding link in the second scissor assembly, where it is also rotatably attached. The roller bar 47 is enclosed within a sheet metal housing 48 similar to the housing 42 enclosing roller bar 41 on the upper platform 21.

In addition to the roller bars 41, 47, the first and second scissor assemblies 23 are coupled together by four L-shaped brackets 51 extending transversely between the corresponding links of the scissor assemblies and attached thereto. In this way, movement of both scissor assemblies is coordinated and the upper platform 21 is maintained parallel to the lower platform at all times. It will be noted that as the upper platform is raised, the right ends of both scissor assemblies 23 remain fixed horizontally by the pivot pins 38, 44. The left ends of the scissor assemblies 23, however, must move toward the right since the scissoring action necessarily decreases the horizontal distance between the ends of the links 31, 32. The rollers 41, 47 allow for such motion. The scissor assemblies thus act as passive guides to maintain a constant parallel orientation between the lower platform 20 and the upper platform 21.

The air bag assembly 25 supplies the lifting force necessary to elevate the load. An air bag is particularly useful in this application since it collapses to a length less than one-half of the fully extended length and thereby allows a compact design. The air bag used in the preferred embodiment is a Goodyear Air-Spring Part No. 2B-202 comprising a reinforced rubber air bag mounted between two aluminum base plates 56, 57. The air bag 54, together with base plates 56, 57 forms an airtight enclosure with the exception of a tapped hole 58 in the lower base plate 56 as shown in FIGS. 2 and 3. Air introduced under pressure into the bag through hole 58 causes the base plates 56, 57 to separate from one another. The bag is shown in a deflated condition in FIG. 2 and in an inflated condition in FIG. 3.

The latching assemblies 27 each include a latching post 61 fixed to the lower platform 20, a plurality of latch plates 62 mounted in a housing 63, which is attached to the upper platform 21, said latch plates adapted to bind against the latch posts when the upper platform is urged downward, and an air-operated piston 65 adapted to prevent the latch plates from binding against the latch post and thereby allow the upper platform to be lowered. One latching assembly 27 is located to the left of the air bag assembly 25 (as viewed in FIGS. 2 and 3) and the second latching assembly is located an equal distance to the right of the air bag assembly. In this way, the load being supported is equally divided between the two assemblies. The construction of each latching assembly 27 is identical and reference may be made to either assembly during the following discussion.

The latch posts 61 are bolted onto the lower platform 20 by a bolt 59 projecting from a reinforcement plate 60 welded to the lower platform. The posts 61 are cylindrical and located approximately midway between the forward and rear scissor assemblies 23.

The latch plate housings 63 are U-shaped channels with two sides 66 and a base 67 and are attached at the top to the underside of the upper platform 21. The base has two circular openings 68, 69. The first opening 68 has a diameter slightly greater than the diameter of the latching post 61 and allows the latching post to enter the housing 63. The second opening 69 allows a spool 71 to extend downward from the air-operated piston 65 to a level flush with the base 67. A bracket 73, having three holes 74, 75, 76 therethrough, extends transversely between the sides 66 of the housing 63 and is attached to each.

The three latch plates 62, each having two holes 78, 79 therethrough and a slot 80 at one end, are retained by a bolt 81 screwed into hole 74 in bracket 73 and projecting downward through holes 78 in the latch plates. The holes 78 have a diameter slightly larger than the diameter of bolt 81 and, therefore, the free ends 84 of the latch plates are free to move up and down. The arc through which the plates 62 might move is limited, however, by the presence of the spool 71 which is received by the slots 80.

The air-operated piston 65 is a single-acting spring-return piston and cylinder assembly of conventional design and construction. The piston 65 is mounted on the bracket 73 by a retaining bolt 85 with a piston rod 86 projecting downward through hole 76 in said bracket. The spool 71 is retained on the piston rod 86. The piston 65 has an air connection (not shown) which is connected with the pneumatic system, as described hereinafter. When pressurized air is supplied, the piston rod 86 moves downward as shown in FIG. 3. When air is vented from the piston 65, the piston rod 86 retracts under the force of the return spring, as shown in FIG. 2. Note that when no air is supplied to the piston 65, the spool 71 elevates the free ends 84 of the latch plates 62 so that the holes 79, which have a diameter slightly larger than the diameter of the latch posts 61, contact the latch posts. When pressurized air is supplied to the piston 65, the spool 71 urges the latch plates 62 downward so that they become perpendicular to the latch posts 61. When the latch plates are perpendicular, they are free to slide past the latch posts.

The operation of the latching assemblies 27 will now be explained. When the vehicle jack 10 is in its collapsed condition, as shown in FIG. 2, the latch plates 62 are canted upward against the latch posts 61. As the upper platform 21 is raised by the air bag assembly 25, the latch plates 62 are raised along with the platform. Since the latch posts are fixed to the lower platform 20, the latch plates 62 must slide upward along the latch posts 61. This is possible since the friction force between the latch plates 62 and the latch posts 61 is in a direction which urges the free ends 84 of the latch plates downward and thus frees the constriction between the latch posts and the latch plates.

When the latch plates 62 are held by the spool 71 in the elevated attitude, as shown in FIG. 2, they act as a safety device preventing accidental collapse of the vehicle jack 10. Should the air bag assembly 25 lose pressure at any time when the upper platform is elevated, the load on the upper platform 21 will tend to collapse the jack 10. In this situation, however, the friction forces between the latch plates 62 and the latch posts 61 are in a direction which urges the free ends 84 of the latch plates upward. Since the diameter of the holes 79 through the latch plates 62 are only slightly larger than the diameter of the latch posts 61, the holes will bind against the latch posts as they are driven further out of a perpendicular orientation. Thus, while the latch plates 62 are free to move upward, any downward movement will cause them to bind and lock against the latch posts 61.

In order to lower the upper platform 21 from an elevated position, it is necessary that the latch plates 62 be forced into an orientation perpendicular to the latch posts 27. This is accomplished by the air-operated piston 65 in the manner described hereinabove.

Figure 4A:
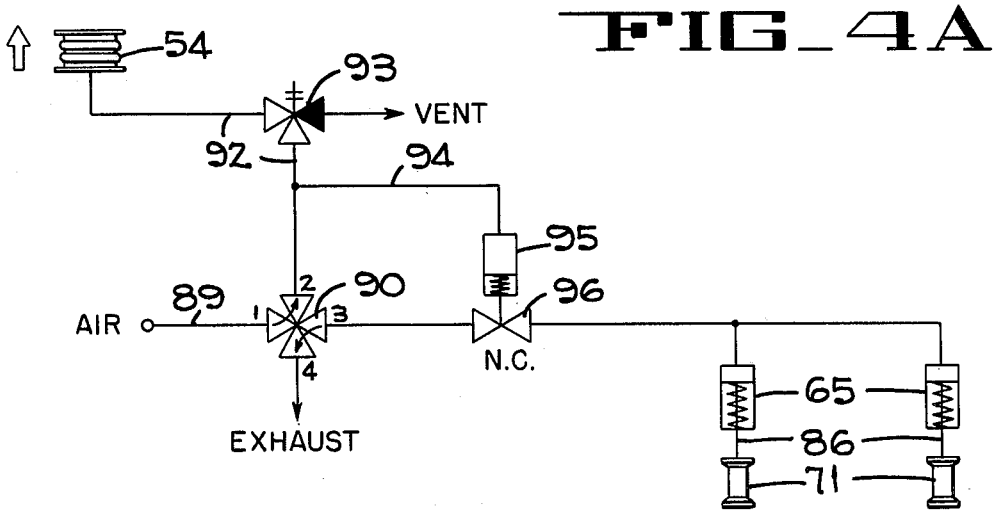
FIGS. 4A, 4B and 4C are schematic representations of the pneumatic system of the vehicle jack illustrating the interlock feature of the present invention.
Figure 4B:
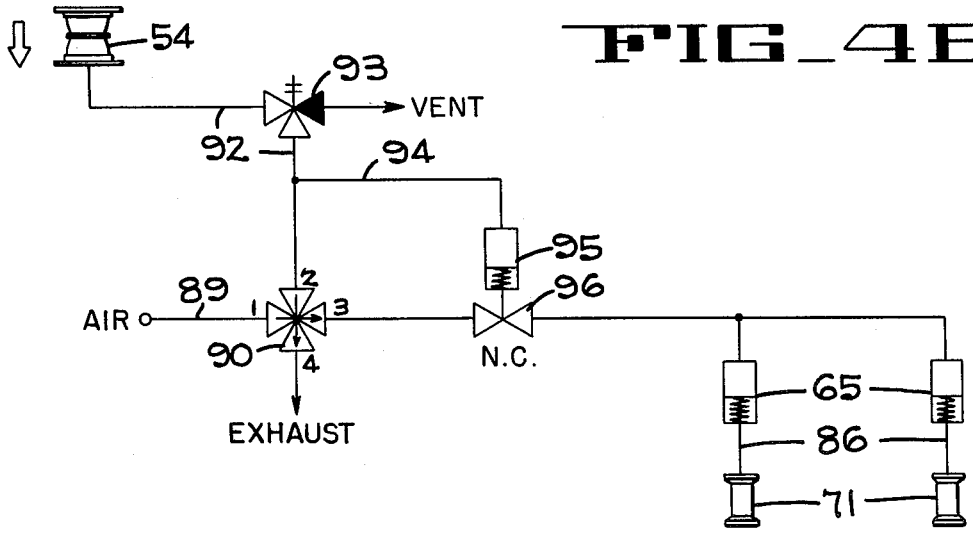
Figure 4C:
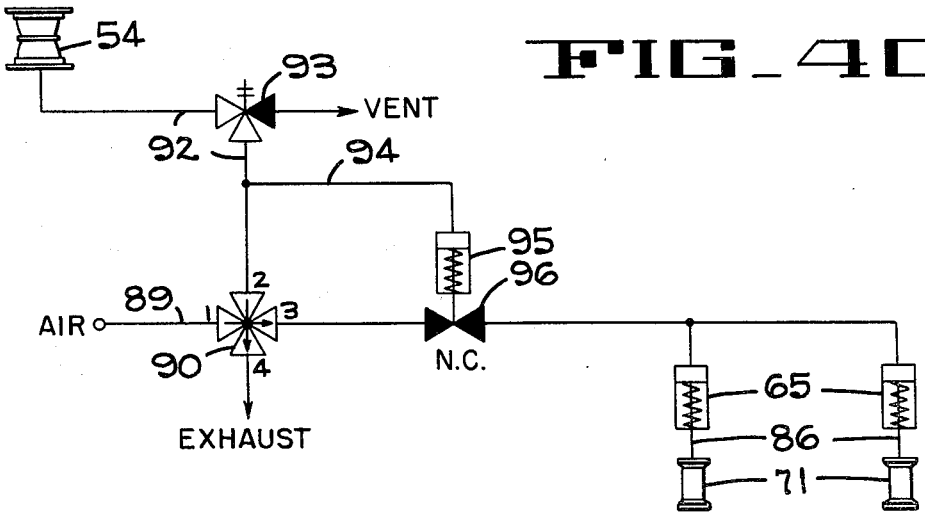

FIGS. 4A, 4B and 4C illustrate the pneumatic piping arrangement in the preferred embodiment. An air supply line 89 is supplied with filtered air at approximately 100 psig. The air supply line 89 is connected to a four port, three position control valve 90, located on the front of the vehicle jack 10, as shown in FIG. 1. A control lever 91 is moved up to raise the jack and down to lower the jack. When released, the control lever 91 returns to its center position and the jack is locked in position by the latching assemblies 27, as discussed hereinabove. The remainder of the piping and valving is located inside the jack.

Valve 90 is shown in the "up" configuration in FIG. 4A. That is, port 1 is connected to port 2 and the 100 psig air is directed through line 92 to the air bag 54. A relief valve 93 in line 92 is set at approximately 130 psig and protects the air bag 54 (which is rated at approximately 150 psig) from over pressure.

A line 94 connects line 92 with an actuator 95 of a pilot valve 96. Pilot valve 96 is normally closed and opens only when the actuator 95 sees pressure sufficient to support a load on the air bag 54. As shown in FIG. 4A, the pilot valve 96 sees the air supply pressure of 100 psig and is open. Port 3 of control valve 90 is connected to the port 1 of pilot valve 96 and port 2 of pilot valve 96 is connected in parallel to the air-operated pistons 65 of the latching assemblies 27. When the control lever 91 is in the "up" position, port 3 of control valve 90 is connected to port 4 which is the exhaust and, as a result, the actuators 95 are vented, raising the spools 71 and allowing the latch plates 62 to assume the canted position against the latch posts 61. Thus, the air bag 54 will raise until the jack 10 is fully extended and will remain in such position thereafter.

When the control lever 91 on control valve 90 is released, the control lever returns to its central position and all valve ports are closed. In this position, the air pressure in air bag 54 should remain constant and provide sufficient force to support the load. In the event air pressure is lost, however, the latching assemblies 27 will prevent the jack 10 from collapsing, as discussed hereinbefore.

In order to lower the vehicle jack 10, the control lever 91 of control valve 90 is depressed, connecting the ports as shown in FIG. 4B. Port 1 is connected to port 3 and the supply air is fed through the pilot valve 96 to the air-operated piston actuators 65. The piston rods 86 are extended and the spools 71 urge the latch plates 62 out of contact with the latch posts 61, thus freeing the upper platform 21 to move downward. Port 2 of control valve 90 is connected with exhaust port 4 and air is bled from the air bag 54 to allow the jack to lower.

FIG. 4C illustrates the configuration of the pneumatic system in the event of an accidental loss of air pressure in the air bag 54. When the control lever 91 on valve 90 is pressed down, the air supply will be directed toward pilot valve 96. Pilot valve 96, however, will be closed since the actuator 95 will see insufficient pressure. Since pilot valve 96 is closed, the air operated pistons 65 will not be actuated and the latching assemblies 27 will not be released. If the latching assemblies 27 could be released, the jack 10 would collapse rapidly.

Although the best mode contemplated for carrying out the present invention has been herein shown and described, it will be apparent that modification and variation may be made without departing from what is regarded to be the subject matter of the invention.

What is claimed is:

1. A mobile vehicle jack for use with a vehicle lift including spaced runways for supporting the wheels of an automotive vehicle, said jack comprising a frame structure extending between said runways, means mounting the jack for travel along said runways, a platform mounted to said frame structure for movement toward and away from said frame structure while maintaining a parallel relationship thereto, vehicle supporting shoes mounted upon said platform, fluid-actuated lifting means secured between said frame structure and said platform for moving said platform upwardly to cause said shoes to engage the undersides of a vehicle, an upright post mounted upon said frame structure and a pivotable latch plate secured to said platform, said latch plate having an aperture therethrough received about said post and causing the latch plate to bind on the post when it is urged to move downwardly relative to the post for preventing an elevated platform from being lowered, a fluid-actuated mechanism for pivoting the latch plate to place the aperture in alignment with the post for permitting relative movement therebetween to permit the platform to be lowered, and fluid-actuated control means for blocking the flow of fluid pressure to said means for releasing, said control means communicating with said pressure in said lifting means so that when such pressure drops below a predetermined level as would properly control the descent of the platform said control means is caused to block the flow of fluid pressure to said means for releasing.

2. A mobile vehicle jack as set forth in claim 1 wherein said control means comprises a valve in a fluid pressure line to said means for releasing and a fluid-actuated, spring-return controller for opening said valve, said controller being connected to the fluid pressure in said lifting means whereby if such pressure drops below said level the spring-return on the controller causes the valve to close.

3. A mobile vehicle jack as set forth in claim 2 wherein said lifting means, said means for pivoting said latch plate and said control means are pneumatically operated means.

4. A mobile vehicle jack as set forth in claim 1 wherein said fluid-actuated lifting means comprises an air bag.

5. A mobile vehicle jack as set forth in claim 2 wherein said platform is secured to said frame structure by a pair of parallel scissor-type assemblies arranged along the sides of said platform and frame structure and wherein said air bag is centrally located between said scissor-type assemblies.

6. A mobile vehicle jack as set forth in claim 1 wherein said mechanism for pivoting the latch plate comprises a fluid-actuated, spring-return piston and cylinder with the de-actuated position of the cylinder serving to pivot the latch plate aperture out of alignment with the post.

7. A mobile vehicle jack for use with a vehicle lift including spaced runways for supporting the wheels of an automotive vehicle, said jack comprising a frame structure extending between said runways, means mounting the jack for travel along said runways, a platform mounted to said frame structure for movement toward and away from said frame structure while maintaining a parallel relationship thereto, vehicle supporting shoes mounted upon said platform, fluid-actuated lifting means secured between said frame structure and said platform for moving said platform upwardly to cause said shoes to engage the undersides of a vehicle, latching means secured between said frame structure and platform for preventing an elevated platform from being lowered, said latching means comprising an upright post secured to said frame structure, a latch plate secured to said platform and having an aperture therethrough for receiving said post, the size of said aperture being such in relationship that the exterior dimensions of said post that diametrically opposed upper and lower side edges of the aperture are caused to bite into the post when the platform is urged to move downwardly on said post, and means for releasing said latching means to permit the platform to be lowered, said means for releasing comprising an actuatable member which is movable to change the orientation of the latch plate relative to said post to release the biting edges of the plate and allow the plate to move downwardly about the post.

8. A mobile vehicle jack as set forth in claim 7 wherein said means for releasing comprises a fluid-actuated cylinder and piston assembly with a spring return, the actuated position of the cylinder and piston assembly moving the latch plate aperture into alignment with the post.

9. A mobile vehicle jack as set forth in claim 8 including pressure sensing means connected to said lifting means to block the flow of fluid under pressure to said cylinder and piston assembly when pressure is lost in said lifting means.

10. A mobile vehicle jack as set forth in claim 9 including a valve for controlling the flow of fluid under pressure to said cylinder and piston assembly, said pressure sensing means including a line connected between said lifting means and said valve to maintain the valve in an open condition when the lifting means is pressurized.

11. A mobile vehicle jack for use with a vehicle lift including spaced runways for supporting the wheels of an automotive vehicle, said jack comprising a frame structure extending between said runways, means mounting the jack for travel along said runways, a platform mounted to said frame structure for movement toward and away from said frame structure while maintaining a parallel relationship thereto, vehicle supporting shoes mounted upon said platform, fluid-actuated lifting means secured between said frame structure and said platform for moving said platform upwardly to cause said shoes to engage the undersides of a vehicle, latching means comprising a post secured to said frame structure and a pivotable latch plate secured to said platform, said latch plate having an aperture therethrough received about said post and causing the latch plate to bind on the post when the platform moves downward relative to the frame structure for preventing an elevated platform from being lowered, fluid-actuated means for pivoting the latch plate to place the aperture in alignment with the post for permitting relative movement between said latch plate and said post to permit the platform to be lowered, and fluid-actuated control means for blocking the flow of fluid pressure to said means for releasing, said control means communicating with said pressure in said lifting means so that when such pressure drops below a predetermined level as would properly control the descent of the platform said control means is caused to block the flow of fluid pressure to said means for releasing.

* * * * *